US009050490B2

(12) United States Patent
Chen

(10) Patent No.: US 9,050,490 B2
(45) Date of Patent: Jun. 9, 2015

(54) REHABILITATION MECHANISM FOR HAND AND LEG

(71) Applicant: Paul Chen, Vancouver (CA)

(72) Inventor: Paul Chen, Vancouver (CA)

( * ) Notice: Subject to any disclaimer, the term of this patent is extended or adjusted under 35 U.S.C. 154(b) by 112 days.

(21) Appl. No.: 13/974,102

(22) Filed: Aug. 23, 2013

(65) Prior Publication Data

US 2015/0057137 A1 Feb. 26, 2015

(51) Int. Cl.
*A63B 21/00* (2006.01)
*A63B 23/035* (2006.01)

(52) U.S. Cl.
CPC ..... *A63B 23/03583* (2013.01)

(58) Field of Classification Search
USPC ..... 482/72, 139, 75, 51
See application file for complete search history.

(56) References Cited

U.S. PATENT DOCUMENTS 4,628,910 A 12/1986 Krukowski
4,691,694 A 9/1987 Boyd et al.
4,765,315 A 8/1988 Krukowski
4,850,585 A * 7/1989 Dalebout ..... 482/51
4,907,797 A 3/1990 Gezari et al.
5,209,223 A 5/1993 McGorry et al.
5,454,773 A 10/1995 Blanchard et al.
5,470,297 A * 11/1995 Park ..... 482/127
5,616,103 A * 4/1997 Lee ..... 482/51
5,624,354 A * 4/1997 Chen ..... 482/51
5,833,574 A * 11/1998 Hsieh ..... 482/51

* cited by examiner

*Primary Examiner* — Jerome w Donnelly
(74) *Attorney, Agent, or Firm* — Charles E. Baxley

(57) ABSTRACT

A rehabilitation mechanism includes a supporting base having a seat member, a frame member is mounted on the supporting base and includes two protrusions each having a pivot shaft, two handle members and two foot supports are pivotal attached to the pivot shaft, and a latch device includes two catch members slidably attached to the handle members and each catch member includes one end for selectively locking the handle member to the frame member and for preventing the handle member from being rotated relative to the frame member, and the catch members each include another end for selectively locking the handle member to the foot support and for allowing the handle member and the foot support to be rotated relative to the frame member altogether.

17 Claims, 4 Drawing Sheets

REHABILITATION MECHANISM FOR HAND AND LEG

BACKGROUND OF THE INVENTION

1. Field of the Invention

The present invention relates to a rehabilitation exercising mechanism or seated walker, and more particularly to a rehabilitation exercising mechanism or seated walker including an adjustable structure or configuration for allowing the user or patient to selectively train or exercise the legs and/or the hands of the user or patient, and including an improved or simplified structure or configuration that may be made or manufactured with a simplified making or manufacturing procedure and with a greatly decreased or reduced manufacturing cost.

2. Description of the Prior Art

Various kinds of typical rehabilitation exercising mechanisms have been developed and provided for conducting or operating various rehabilitation exercises for actuating or operating the legs and/or the hands of the user, or the lower muscle groups and/or the upper muscle groups of the user, and normally comprise a rather complicated structure or configuration that may not be easily and quickly made or manufactured and that may include a complicated making or manufacturing procedure and that may include a greatly increased manufacturing cost.

For example, U.S. Pat. No. 4,628,910 to Krukowski, U.S. Pat. No. 4,691,694 to Boyd et al., U.S. Pat. No. 4,765,315 to Krukowski, U.S. Pat. No. 5,209,223 to McGorry et al., and U.S. Pat. No. 5,454,773 to Blanchard et al. discloses several of the typical rehabilitation exercising mechanisms provided for training and/or exercising the legs and/or the lower muscle groups of the user.

However, the typical rehabilitation exercising mechanisms for the hands and/or the upper muscle groups of the user comprise a rather complicated structure or configuration that may not be easily and quickly made or manufactured and that may include a complicated making or manufacturing procedure and that may include a greatly increased manufacturing cost, and that the typical rehabilitation exercising mechanisms may be used for training and/or exercising the legs and/or the lower muscle groups of the user, but may not be used for training and/or exercising the hands and/or the upper muscle groups of the user.

U.S. Pat. No. 4,907,797 to Gezari et al. discloses another typical rehabilitation exercising mechanism including a structure or configuration provided for training and/or exercising the hands and/or the upper muscle groups of the user only, but may not be used for training and/or exercising the legs and/or the lower muscle groups of the user.

The present invention has arisen to mitigate and/or obviate the afore-described disadvantages of the conventional rehabilitation exercising mechanisms.

SUMMARY OF THE INVENTION

The primary objective of the present invention is to provide a rehabilitation exercising mechanism or seated walker including an adjustable structure or configuration for allowing the user or patient to selectively train or exercise the legs and/or the hands of the user or patient, and including an improved or simplified structure or configuration that may be made or manufactured with a simplified making or manufacturing procedure and with a greatly decreased or reduced manufacturing cost.

In accordance with one aspect of the invention, there is provided a rehabilitation mechanism or seated walker comprising a supporting base including a seat member provided thereon for supporting a user thereon, and including a frame member mounted on the supporting base, and the frame member including two protrusions extended therefrom and including a pivot shaft extended from each of the protrusions, two handle members each including a tube engaged onto the pivot shaft and pivotal relative to the pivot shaft, two foot supports each including a sleeve engaged onto the pivot shaft and pivotal relative to the pivot shaft, and a latch device including two catch members slidably attached to the handle members respectively, and the catch members each including a first end portion for selectively engaging with the protrusion of the frame member and for selectively locking the handle member to the protrusion of the frame member and for preventing the handle member from being pivoted and rotated relative to the frame member and the supporting base, and the catch members each including a second end portion for selectively engaging with the foot support and for selectively locking the handle member to the foot support and for allowing the handle member and the foot support to be selectively pivoted or rotated relative to the frame member and the supporting base altogether.

The frame member includes a stop disposed on the pivot shaft and engageable with the tube of the handle member for limiting the handle member to move relative to the pivot shaft. The frame member includes an ear extended from each of the protrusions and having one or more openings or orifices formed in the ear for selectively or changeably engaging with the first end portion of the catch member.

The foot supports each include a flap extended therefrom and having one or more apertures formed in the flap for selectively engaging with the second end portion of the catch member and for selectively latching or locking the foot supports to the frame member and the supporting base. The handle members each include a barrel having a bore formed in the barrel for selectively and slidably receiving and engaging with the catch member and for selectively latching or locking or positioning the latch member to the barrel.

The latch device includes a knob attached to each of the catch members for selectively operating and moving the catch member relative to the barrel and the handle member. The barrels of the handle members each include a first opening and a second opening formed therein and communicating with the bore of the barrel for selectively engaging with the knob and for selectively positioning the knob to the barrel at selected positions.

The knobs each include a relatively reduced engaging portion having a decreased outer diameter for selectively engaging into either of the first opening or the second opening of the barrel and thus for positioning the knob to the barrel at the selected positions. The barrels of the handle members each include a groove formed therein and located between the first and the second openings of the barrel and communicating with the bore and the first and the second openings of the barrel for allowing the catch member to be moved between the first and the second openings of the barrel.

The latch device includes a fastener engaged with each of the catch members and slidably engaged in the groove of the barrel and engageable into either of the first and the second openings of the barrel. The knobs each include a compartment formed therein for receiving the fastener, and a spring biasing member is engaged into the compartment of each knob and engaged between the knob and the fastener for biasing the knob to selectively engage with either of the first opening or the second opening of the barrel and to position the knob to the barrel at the selected positions.

The foot supports each include a foot pedal slidably provided thereon for selectively engaging with a foot of the user and for allowing the user to move or pivot or rotate the foot support relative to the frame member and the supporting base. The foot supports each include an extension slidably and adjustably attached to a lower portion of the foot support and having the foot pedal provided on the extension for supporting the foot of the user and for allowing the extension and the foot pedal to be stepped and moved by the user.

The foot supports each include a pulley for engaging with a spring biasing cable which may apply a spring biasing force to the foot supports and to resist the pivotal movement of the foot supports and/or the handle members relative to the supporting base, and to resist the sliding movement of the extension and the foot pedal relative to the foot support.

The foot supports each include a retainer attached to the extension and engaged with the cable, a hook attached to the foot support and engaged with the cable which is coupled to the supporting base to apply the spring biasing force to resist the pivoting or rotating movement of the foot support relative to the supporting base and/or to resist the sliding movement of the extension and the foot pedal relative to the foot support.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
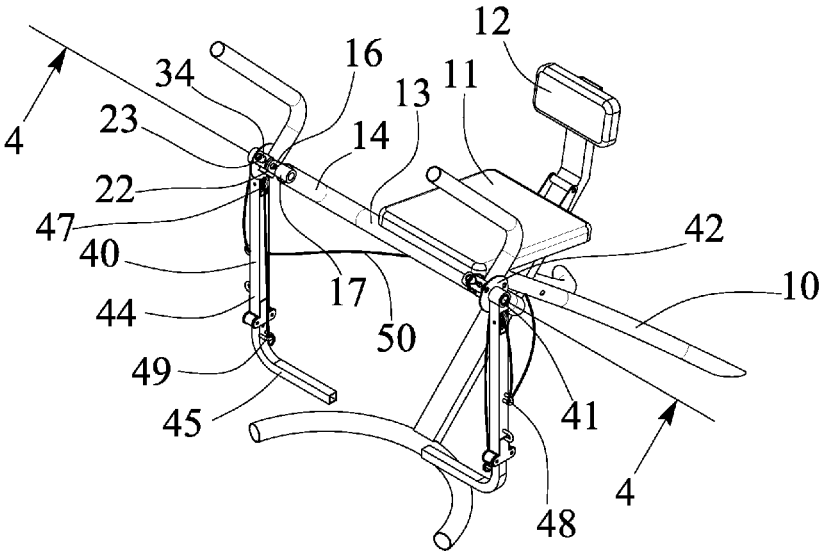
FIG. 1 is a perspective view of a rehabilitation mechanism or seated walker in accordance with the present invention.
Figure 2:
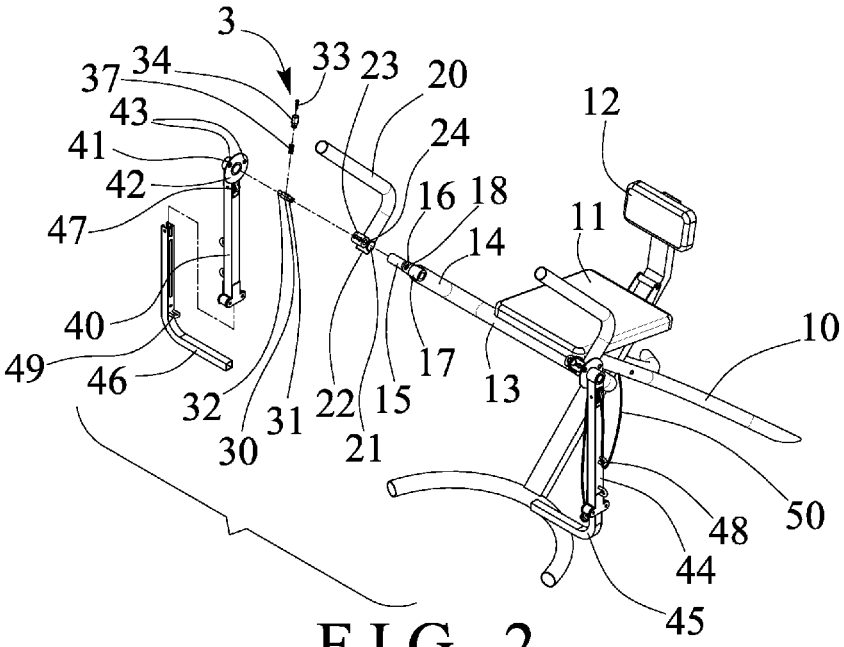
FIG. 2 is a partial exploded view of the rehabilitation mechanism or seated walker.

Referring to the drawings, and initially to FIGS. 1-4, a rehabilitation exercising mechanism or seated walker in accordance with the present invention comprises a supporting base 10 which may include either a one integral piece structure or configuration or a foldable structure or configuration, however, either the one integral piece structure or the foldable structure of the supporting base 10 is not related to the present invention and will not be described in further details. The supporting base 10 includes a seat cushion or seat member 11 formed or provided thereon for stably and safely and comfortably supporting or seating a user or patient thereon, and includes a seat back member 12 formed or provided thereon for stably and safely and comfortably supporting the back portion of the user or patient, and for preventing the user or patient from falling down from the seat member 11.

Figure 3:
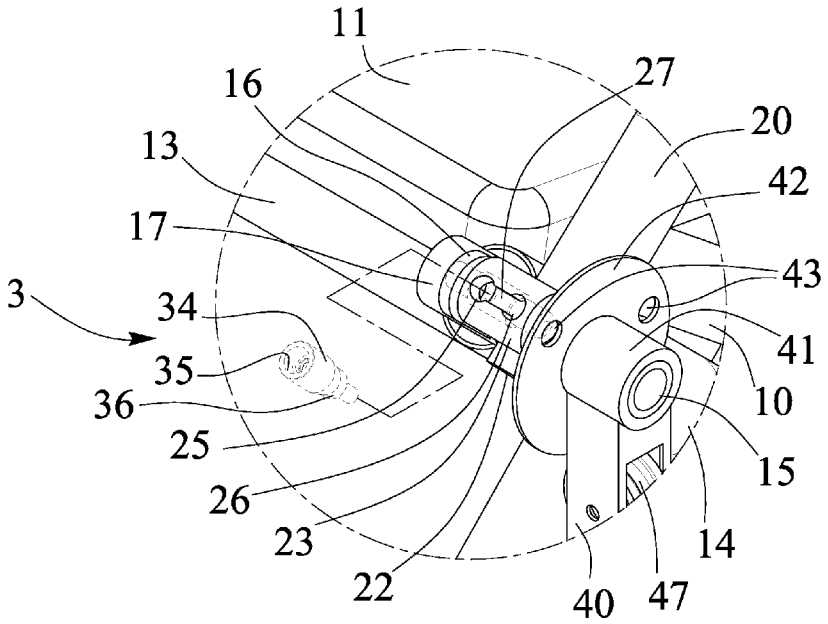
FIG. 3 is an enlarged partial exploded view of the rehabilitation mechanism or seated walker.
Figure 4:
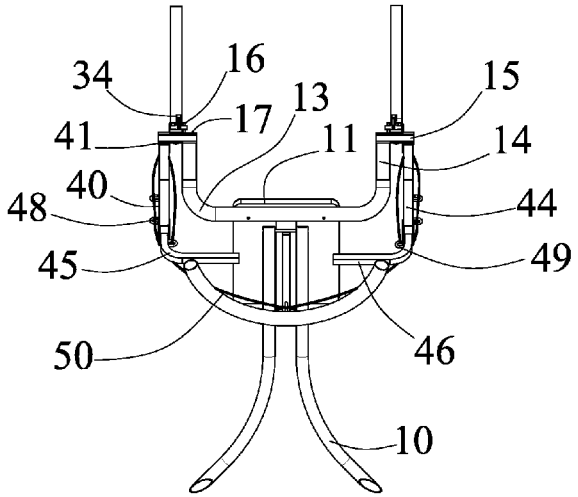
FIG. 4 is a partial cross sectional view of the rehabilitation mechanism or seated walker, taken along lines 4-4 of FIG. 1.
Figure 5:
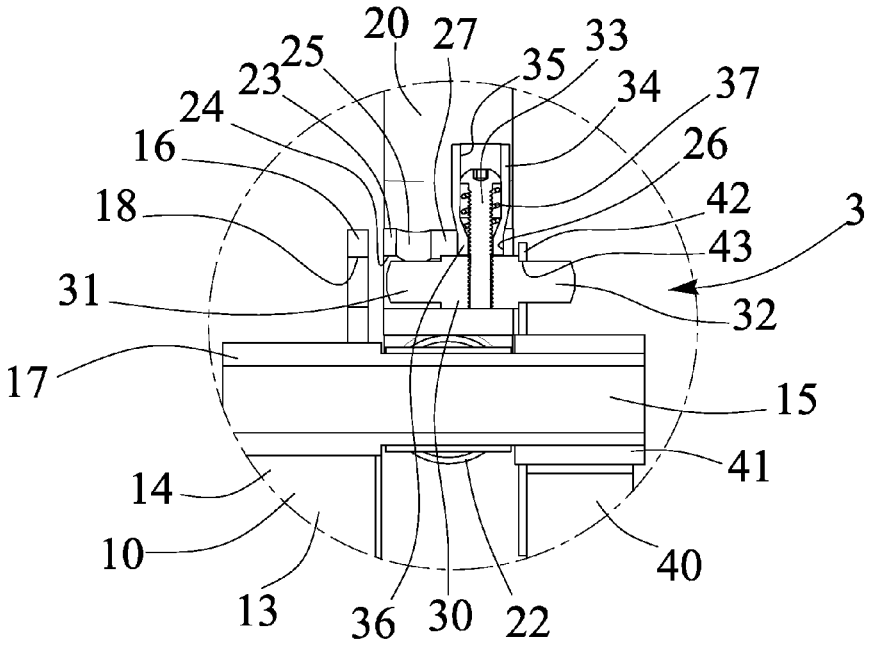
FIG. 5 is an enlarged partial cross sectional view of the rehabilitation mechanism or seated walker.
Figure 7:
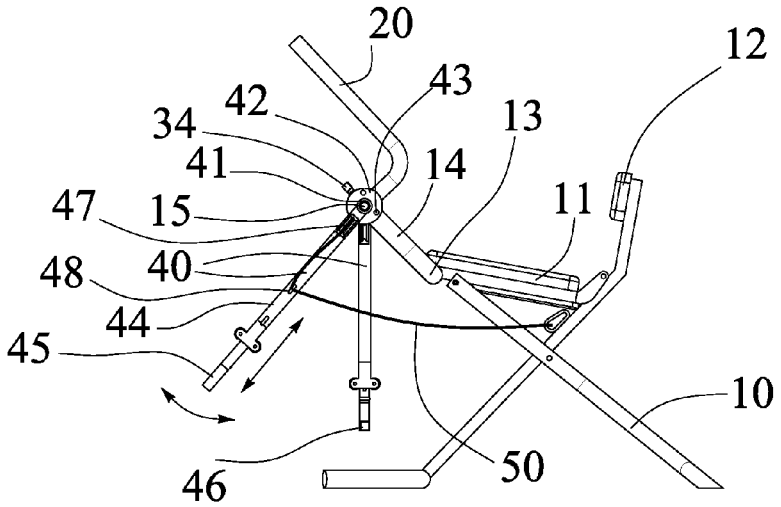
FIGS. 7, 8 are side plan schematic views illustrating the operation of the rehabilitation mechanism.
Figure 8:
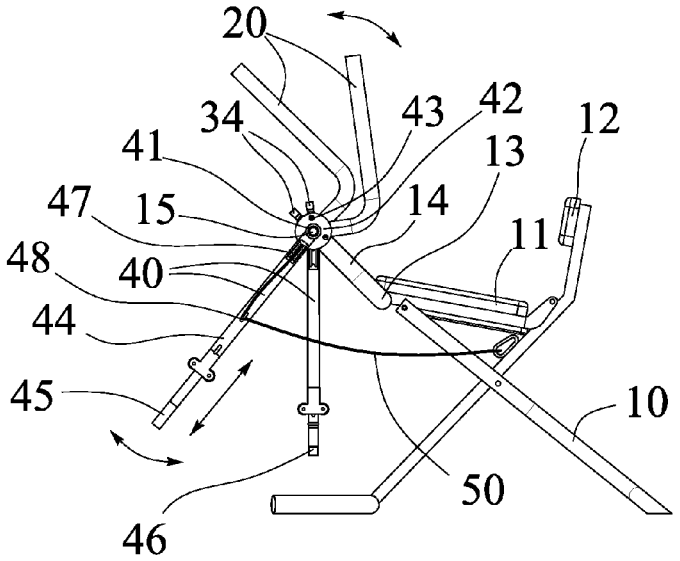

The supporting base 10 further includes a supporting frame member 13, such as a U-shaped frame member 13 formed or provided thereon and disposed or attached or mounted or secured or extended or located at the front portion of the supporting base 10, and/or at the front portion of the seat member 11, best shown in FIGS. 7 and 8, and the frame member 13 includes two arms or limbs or extensions or protrusions 14 extended forwardly and upwardly therefrom, and includes an axle or pivot shaft 15 extended laterally and outwardly from the free end portion of each protrusion 14, and preferably, but not necessary that the pivot shaft 15 is perpendicular to the respective protrusion 14, and includes a projection or flap or ear 16 extended from the pivot shaft 15 and/or from the protrusion 14, and includes a barrel or stop 17 disposed or attached or mounted or secured on the pivot shaft 15 and/or the protrusion 14, and the ear 16 includes an orifice 18 formed therein (FIGS. 3, 5).

The rehabilitation exercising mechanism further includes two handle members 20 each having a ring or sleeve or barrel or tube 21 formed or provided at one end or lower or bottom portion 22 thereof and pivotally or rotatably attached or mounted or secured or engaged onto the pivot shaft 15 and pivotal or rotatable relative to the pivot shaft 15, best shown in FIG. 8, and the tubes 21 of the handle members 20 are contactable or engageable with the stops 17 of the protrusions 14 of the frame member 13 which may limit the handle members 20 to move relative to the pivot shaft 15, the handle members 20 each further include a ring or tube or sleeve or barrel 23 attached or mounted or secured on the one end portion 22 thereof or on the tube 21, and the barrel 23 includes a lateral or longitudinal orifice or bore 24 formed therein (FIGS. 2, 5) and selectively aligned with the orifice 18 of the ear 16 of the pivot shaft 15 and/or of the protrusion 14, and includes two openings 25, 26 formed therein and communicating with the bore 24 thereof (FIG. 5), and includes a channel or slot or groove 27 formed therein and located between the openings 25, 26 thereof and communicating with the bore 24 and the openings 25, 26 thereof.

The handle members 20 each further include a lock or latch device 3 having a cylindrical lock or latch or catch member 30 slidably received or engaged in the bore 24 of the respective barrel 23, and the catch member 30 includes two end portions 31, 32 extendible out of the barrel 23 respectively, for example, the one or first end portion 31 of the catch member 30 is selectively extendible out of the barrel 23 (FIGS. 4, 5) for selectively engaging with the orifice 18 of the ear 16 of the pivot shaft 15 and/or of the protrusion 14, and for solidly and stably locking or latching the handle member 20 to the protrusion 14 of the frame member 13, and for preventing the handle member 20 from being pivoted or rotated relative to the frame member 13 and the supporting base 10.

The latch device 3 further includes a latch or catch or fastener 33 threaded or engaged with the respective catch member 30 (FIG. 5) and slidably received or engaged in the groove 27 of the respective barrel 23 and movable or engageable into either of the openings 25, 26 of the barrel 23, a button or hand grip or knob 34 having a chamber or compartment 35 formed therein for slidably receiving or engaging with the fastener 33 and for allowing the knob 34 to be slidably attached or mounted or engaged onto the fastener 33 and the catch member 30 and for selectively moving the fastener 33 and the catch member 30 relative to the barrel 23 and the handle member 20, in which the knob 34 includes a relatively reduced or narrowed neck or lower or engaging portion 36 having a relatively reduced or decreased size or dimension or outer diameter for selectively engaging with or into either of the openings 25, 26 of the barrel 23 (FIG. 5).

The knob 34 includes an outer diameter greater than the inner diameter of the openings 25, 26 of the barrel 23 and may not be engaged into the openings 25, 26 of the barrel 23, but the relatively reduced engaging portion 36 of the knob 34 includes an outer diameter equal to or smaller than the inner diameter of the openings 25, 26 of the barrel 23 for allowing the relatively reduced engaging portion 36 of the knob 34 to be selectively engaged into either of the openings 25, 26 of the barrel 23. For example, when the relatively reduced engaging portion 36 of the knob 34 is engaged into either of the openings 25, 26 of the barrel 23, the knob 34 may be anchored or retained or positioned to the barrel 23 at the selective location or position and may not be slid or moved along or relative to the barrel 23. A spring biasing member 37 is engaged into the compartment 35 of each knob 34 and engaged between the knob 34 and the fastener 33 for biasing and forcing or moving the engaging portion 36 of the knob 34 to selectively engage into either of the openings 25, 26 of the barrel 23.

On the contrary, when the relatively reduced engaging portion 36 of the knob 34 is removed upwardly away from or disengaged from the openings 25, 26 of the barrel 23, the knob 34 may be slid or moved along or relative to the barrel 23 in order to selectively move the fastener 33 and the catch member 30 along or relative to the barrel 23, and for allowing the relatively reduced engaging portion 36 of the knob 34 to be moved to engage with the other opening 26, 25 of the barrel 23. For example, when the knob 34 is engaged with one of the openings or the first opening 25 of the barrel 23 (FIG. 4), the one or first end portion 31 of the catch member 30 is extended out of the barrel 23 to selectively engage with the orifice 18 of the ear 16 of the pivot shaft 15 and/or of the protrusion 14, and to lock or latch the handle member 20 to the protrusion 14 of the frame member 13.

On the contrary, when the knob 34 is engaged with the other or the second opening 26 of the barrel 23 (FIGS. 5, 6), the other or the second end portion 32 of the catch member 30 is extended out of the barrel 23 for selectively engaging with a shaft or shank or pendulum or lever or foot support 40. For example, the foot support 40 includes a tube or barrel or ring or sleeve 41 formed or provided at one end or top or upper portion thereof and pivotally or rotatably attached or mounted or secured or engaged onto the pivot shaft 15 and pivotal or rotatable relative to the pivot shaft 15, best shown in FIGS. 7 and 8, and includes another ear or projection or flap 42 extended from the top or upper portion of the foot support 40 and having one or more (such as two) apertures 43 formed in the flap 42 for selectively engaging with the other or the second end portion 32 of the catch member 30 (FIGS. 5, 6) which may lock or latch the handle member 20 to the foot support 40 for allowing the handle member 20 and the foot support 40 to be selectively pivoted or rotated relative to the frame member 13 and the supporting base 10 altogether (FIG. 8).

Figure 6:
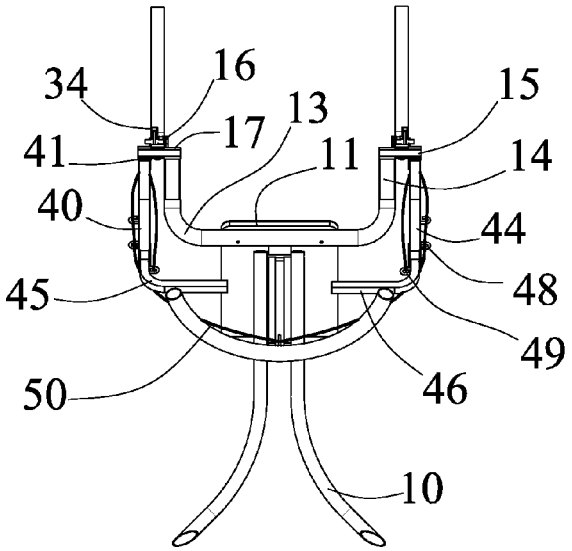
FIG. 6 is a partial cross sectional view of the rehabilitation mechanism similar to FIG. 4, illustrating the operation of the rehabilitation mechanism.

The foot support 40 further includes a sliding or adjusting member or extension 45 slidably and adjustably attached or mounted or engaged into the lower or bottom portion 44 of the foot support 40 and having a foot member or foot pedal 46 formed or provided at one end or lower or bottom portion of the extension 45 for selectively engaging with or supporting the foot of the user or patient and for allowing the user or patient to move or pivot or rotate the foot support 40 relative to the frame member 13 and the supporting base 10 (FIG. 7) and for conducting or operating various rehabilitation movements or exercises to selectively actuate or operate or train or exercise the legs and/or the lower muscle groups of the user, or selectively actuate or operate or train or exercise the hands and/or the upper muscle groups of the user when the handle member 20 is selectively locked or latched to the foot support 40 (FIGS. 6, 8).

The foot supports 40 each may further include one or more rollers or wheels or pulleys 47 attached or mounted or secured or provided thereon for selectively engaging with one or more spring biasing members or resilient cords or ropes or cables 50 which are engaged with or between the foot supports 40 and the extension 45 and the foot pedal 46 and the frame member 13 and/or the supporting base 10 for applying a spring biasing force between the foot supports 40 and the extension 45 and the foot pedal 46 and for resisting the movement of the extension 45 and the foot pedal 46 relative to the foot support 40 and/or the movement between the foot supports 40 and the supporting base 10, and thus for allowing the user or patient to selectively train or exercise the legs or the lower muscle groups of the user or patient.

For example, the foot supports 40 each include a pulley 47 engaged therein and located close to the sleeve 41, one or more anchors or retainers or positioners or hooks 48 attached or mounted or secured to the respective foot support 40, and one or more further anchors or positioners or hooks or retainers 49 attached or mounted or secured to the respective extension 45. The spring biasing cables 50 may be engaged between the foot supports 40 and the extension 45 and the foot pedal 46 and may be coupled to the frame member 13 and/or the supporting base 10 for applying the spring biasing force to the extension 45 and the foot pedal 46. For example, the spring biasing cables 50 are coupled to the supporting base 10 and engaged with the hooks 48 and engaged with or over the pulleys 47, and then engaged with or coupled to the retainers 49 of the extensions 45 respectively.

In operation, the user or patient may be stably and safely and comfortably seated and supported on the seat member 11, and the feet of the user or patient may step on and engage with the foot member or foot pedal 46 of the foot support 40 and may move or pivot or rotate the foot support 40 relative to the frame member 13 and the supporting base 10 (FIG. 7), and may also step and move the extension 45 and the foot pedal 46 relative to or along or toward or away from the foot support 40 in order to conduct or operate various rehabilitation exercises to selectively actuate or operate or train or exercise the legs and/or the lower muscle groups of the user. It is to be noted that the user or patient not only may move or pivot or rotate the foot support 40 forwardly and rearwardly relative to the supporting base 10 (FIG. 7), but also may step and move the extension 45 and the foot pedal 46 relative to or along or toward or away from the foot support 40 (FIGS. 7, 8).

The spring biasing cables 50 may apply the spring biasing force to resist the pivoting or rotating movement of the foot supports 40 relative to the supporting base 10 respectively, and/or may apply the spring biasing force to resist the sliding movement of the extensions 45 and the foot pedals 46 relative to the foot supports 40 respectively. Alternatively, as shown in FIGS. 6 and 8, when the handle member 20 is selectively locked or latched to the foot support 40, the user may hold or grip or grasp the handle members 20 to pivot or rotate the foot support 40 relative to the frame member 13 and the supporting base 10 in order to conduct or operate various rehabilitation exercises to selectively actuate or operate or train or exercise the hands and/or the upper muscle groups of the user. At this moment, the user may also move or pivot or rotate the foot support 40 forwardly and rearwardly relative to the supporting base 10 and may also step and move the extension 45 and the foot pedal 46 relative to or along or toward or away from the foot support 40.

Accordingly, the rehabilitation mechanism in accordance with the present invention includes an adjustable structure or configuration for allowing the user or patient to selectively train or exercise the legs and/or the hands of the user or patient, and including an improved or simplified structure or configuration that may be made or manufactured with a simplified making or manufacturing procedure and with a greatly decreased or reduced manufacturing cost.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rehabilitation mechanism comprising:

a supporting base including a seat member provided thereon for supporting a user thereon, and including a frame member mounted on said supporting base, and said frame member including two protrusions extended therefrom and including a pivot shaft extended from each of said protrusions, two handle members each including a tube engaged onto said pivot shaft and pivotal relative to said pivot shaft, two foot supports each including a sleeve engaged onto said pivot shaft and pivotal relative to said pivot shaft, and a latch device including two catch members slidably attached to said handle members respectively, and said catch members each including a first end portion for selectively engaging with said protrusion of said frame member and for selectively locking said handle member to said protrusion of said frame member and for preventing said handle member from being pivoted and rotated relative to said frame member and said supporting base, and said catch members each including a second end portion for selectively engaging with said foot support and for selectively locking said handle member to said foot support and for allowing said handle member and said foot support to be selectively rotated relative to said frame member and said supporting base altogether.

2. The rehabilitation mechanism as claimed in claim 1, wherein said frame member includes a stop disposed on said pivot shaft and engageable with said tube of said handle member for limiting said handle member to move relative to said pivot shaft.

3. The rehabilitation mechanism as claimed in claim 1, wherein said frame member includes an ear extended from each of said protrusions and having an orifice formed in said ear for selectively engaging with said first end portion of said catch member.

4. The rehabilitation mechanism as claimed in claim 1, wherein said foot supports each include a flap extended therefrom and having an aperture formed in said flap for selectively engaging with said second end portion of said catch member.

5. The rehabilitation mechanism as claimed in claim 1, wherein said handle members each include a barrel having a bore formed in said barrel for selectively and slidably receiving and engaging with said catch member.

6. The rehabilitation mechanism as claimed in claim 5, wherein said latch device includes a knob attached to each of said catch members for selectively moving said catch member relative to said barrel and said handle member.

7. The rehabilitation mechanism as claimed in claim 6, wherein said barrels of said handle members each include a first opening and a second opening formed therein and communicating with said bore of said barrel for selectively engaging with said knob and for selectively positioning said knob to said barrel at selected positions.

8. The rehabilitation mechanism as claimed in claim 7, wherein said knobs each include a relatively reduced engaging portion having a decreased outer diameter for selectively engaging into either of said first opening or said second opening of said barrel.

9. The rehabilitation mechanism as claimed in claim 7, wherein said barrels of said handle members each include a groove formed therein and located between said first and said second openings of said barrel and communicating with said bore and said first and said second openings of said barrel.

10. The rehabilitation mechanism as claimed in claim 9, wherein said latch device includes a fastener engaged with each of said catch members and slidably engaged in said groove of said barrel and engageable into either of said first and said second openings of said barrel.

11. The rehabilitation mechanism as claimed in claim 10, wherein said knobs each include a compartment formed therein for receiving said fastener, and a spring biasing member is engaged into said compartment of each knob and engaged between said knob and said fastener for biasing said knob to selectively engage with either of said first opening or said second opening of said barrel.

12. The rehabilitation mechanism as claimed in claim 1, wherein said foot supports each include a foot pedal for selectively engaging with a foot of the user and for allowing the user to pivot said foot support relative to said frame member and said supporting base.

13. The rehabilitation mechanism as claimed in claim 12, wherein said foot supports each include an extension slidably and adjustably attached to a lower portion of said foot support and having said foot pedal provided on said extension for supporting the foot of the user.

14. The rehabilitation mechanism as claimed in claim 13, wherein said foot supports each include a cable engaged between said foot support and said extension for applying a spring biasing force between said foot support and said extension and said foot pedal and for resisting a movement of said extension and said foot pedal relative to said foot support.

15. The rehabilitation mechanism as claimed in claim 14, wherein said foot supports each include a pulley engaged with said cable which applies a spring biasing force to said foot supports.

16. The rehabilitation mechanism as claimed in claim 14, wherein said foot supports each include a retainer attached to said extension and engaged with said cable.

17. The rehabilitation mechanism as claimed in claim 14, wherein said foot supports each include a hook engaged with said cable which is coupled to said supporting base.

* * * * *